US006964109B1

(12) United States Patent
Bond

(10) Patent No.: US 6,964,109 B1
(45) Date of Patent: Nov. 15, 2005

(54) STRING LINE BOX TOOL

(76) Inventor: William R. Bond, 4710 Asdee La., Woodbridge, VA (US) 22192

( * ) Notice: Subject to any disclaimer, the term of this patent is extended or adjusted under 35 U.S.C. 154(b) by 18 days.

(21) Appl. No.: 10/902,575

(22) Filed: Jul. 30, 2004

(51) Int. Cl.[7] ..... B44D 3/38
(52) U.S. Cl. ..... 33/414; 33/1 LE
(58) Field of Search ..... 33/1 LE, 393, 33/409, 413, 414, 756

(56) References Cited

U.S. PATENT DOCUMENTS

| | | | | |
|---|---|---|---|---|
| 2,505,935 | A * | 5/1950 | Batchler | 33/409 |
| 2,589,500 | A | 3/1952 | Landon et al. | |
| 2,749,618 | A | 6/1956 | Landon | |
| 3,122,836 | A * | 3/1964 | Aciego | 33/413 |
| 5,119,565 | A * | 6/1992 | Horvath et al. | 33/414 |
| 5,699,622 | A * | 12/1997 | Umbro | 33/414 |
| 6,098,299 | A | 8/2000 | Collins et al. | |
| 2002/0088133 | A1 | 7/2002 | McMillan | |
| 2004/0211074 | A1 * | 10/2004 | Tessel et al. | 33/414 |
| 2005/0076520 | A1 * | 4/2005 | Vary | 33/414 |

* cited by examiner

*Primary Examiner*—G. Bradley Bennett
(74) *Attorney, Agent, or Firm*—Palmer C. DeMeo

(57) ABSTRACT

A string line box tool comprising a chalk line box and a line block integral therewith used for guiding a string line rewardly from the chalk line box through a groove in the line block in order to provide a free holding string line for carpentry or construction work. To effect this condition the hook shaped protrusion of the line block will hook onto one end of a work project while the L-shaped metal tab on the free end of the string line will hook onto the opposite end of the work project, the string line being under tension during this condition.

20 Claims, 4 Drawing Sheets

STRING LINE BOX TOOL

BACKGROUND OF THE INVENTION

1. Field of the Invention

The present invention relates to a string line box tool for alignment work in carpentry in particular and construction in general.

2. Description of the Related Art

Chalk line boxes are conventionally used in construction work to provide a visible line on a work piece such as wall, floor or ceiling. For example, U.S. Pat. No. 6,098,299 discloses the use of a chalk box in providing a chalk dust line on a wall. The operation of such a chalk box in providing such a chalk dust line is well known. A nail is generally used to secure one or both ends of the chalk line box or a nail and a worker are used to secure both ends of the chalk line box. FIG. 8 of U.S. 2002/0088133 shows an example where a nail is used to support both ends of a chalk line box, i.e., the free end of the chalk line box and the housing of the chalk line box, and FIG. 1 of U.S. Pat. No. 6,098,299 shows an example where a nail is used to secure the free end of a chalk line box and a worker is used to support the housing of the chalk line box.

SUMMARY OF THE INVENTION

The main purpose of the string line box tool of this invention is to provide a free holding string line for various construction projects. In order to accomplish this purpose a conventional chalk line box is provided with an additional element or line block at the string opening end of the chalk line box. This element or line block has a hook like protrusion at one end thereof and a string line guide along the length thereof for directing the free end of the string line rearwardly when it is pulled by a worker. The free end of the chalk line box of this invention has the conventional metal L-shaped hook which is positioned on an edge of one end of the work project. Then, a worker, with the housing of the string line box tool in hand, pulls under tension the string line attached to the metal L-shaped hook backwards through the guide of the line block to an opposite end of the work project and slips the hook like protrusion of the element to an edge at the opposite end of the work project. Since the string line is under sufficient tension during this process the string line box tool with its housing, string line and metal L-shaped hook is held in suspension between the two ends of the work project. No nail or worker is required to hold any end of the string line box tool of this invention.

Thus, it is an object of this invention to provide a free holding chalk line box during various construction projects.

It is an object of this invention to eliminate the use of a nail or worker to secure or support the chalk line box during use.

Yet, another object of this invention is to save time during the use of a chalk line box for various construction projects.

It is a further object of this invention to modify the conventional chalk line box and make it easier to work with during various construction projects.

Other objects and advantages of the use of the string line box tool of this invention will become apparent upon reading the following description of which the attached drawings form a part.

DETAILED DESCRIPTION OF THE PREFERRED EMBODIMENTS

Figure 1:
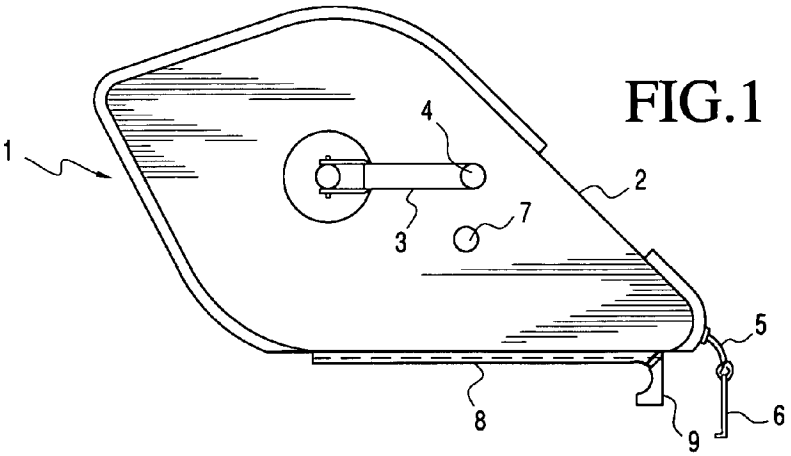
FIG. 1 is a side view of the string line box tool of this invention.

Referring to FIG. 1, there is shown a string line box tool 1 of this invention. The string line box tool 1 is made up from a conventional chalk line box 2 and an elongated element or line block 8 with a hook shaped protrusion 9 at one end thereof and a string line guide along the length thereof. The elongated element or line block 8 is affixed along one side edge of a chalk box 2. Further details of this elongated element or line block 8 will be set forth hereinafter. The chalk line box 2 of this invention has the conventional crank 3 and handle 4, string line 5, L-shaped metal tab 6 attached to the free end of the string line 5 and a hole or well 7 in the side thereof for locking the crank 3. As is well known, the crank 3 is used to wind the string 5 into the chalk line box 2 and to lock the chalk line box 2. The chalk line box 2 can have an automatic lock system built into it. The chalk line box 2 of this invention is made of two half sections which are joined together by screws (not seen in FIGS. 1, 2, 4 and 5 since they are on opposite sides from the crank 3). The mechanism and chalk holder inside the chalk line box 2 are similar to that disclosed in U.S. Pat. No. 2,589,500 and the L-shaped metal tab 6 is similar to that disclosed in U.S. Pat. No. 4,660,291. The two half sections of the chalk line box 2 can be made from metal, plastic or other suitable material.

Figure 2:
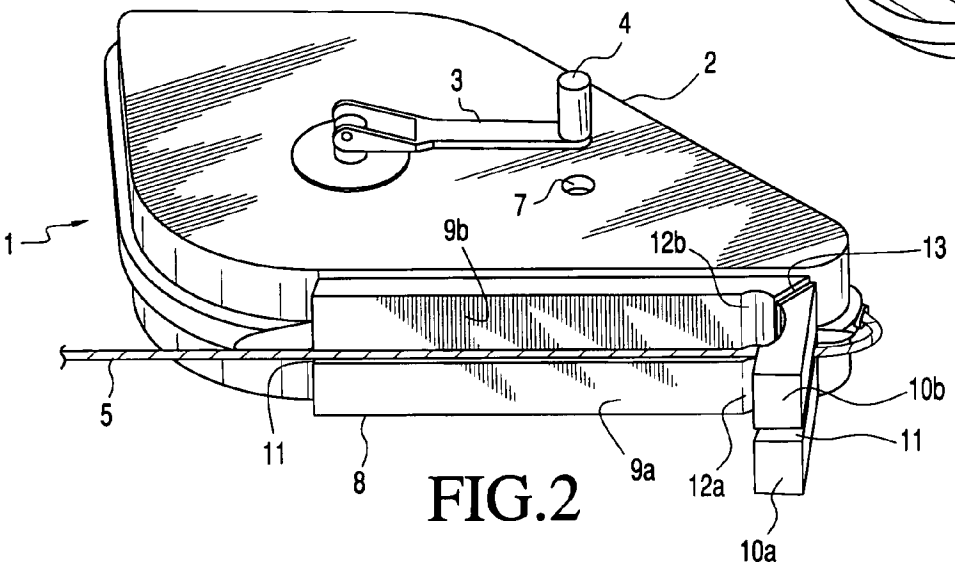
FIG. 2 is a perspective view of the string line box tool of this invention in an unlocked condition.

A more detailed view of the elongated element 8 (hereinafter referred to as "line block") is shown in FIG. 2. The line block 8 in this embodiment is made of two separate pieces, each having a flat body section 9*a* or 9*b* of a given thickness, e.g., ⅛ inch to ¼ inch, and a hook shaped protrusion 10*a* or 10*b* near the business end of the chalk line box 2. There is a spacing 11 of about 1/16 inch between the two sections 9*a* and 9*b* along its entire length and between the two hook shaped protrusions 10*a* and 10*b* so that the string line 5 can be guided and pulled back by a worker during a particular application as will be explained later. The height of each hook shaped protrusion 10*a* and 10*b* is approximately 11/16 inch from the base of the flat body section 9*a* or 9*b*, respectively. There is also a rounded section 12*a* or 12*b* between the flat body sections 9*a* and 9*b*, respectively, and the top portion of the hook shaped protrusion 10*a* and 10*b*, respectively. Each of the rounded sections 12*a* and 12*b* is approximately ¼ inch half round. Each of the hook shaped protrusions 10*a* and 10*b* has a height of about 11/16 inch, a thickness of about 3/16 inch and a width of about 7/16 inch. The overall length of each of the two separate pieces of line block 8 is approximately 3 inches. The spacing between the two pieces of line block 8 is approximately 1/16 inch in order for the string line 5 to pass therethrough and the depth of the groove formed between the two sections 9*a* and 9*b* of the line block 8 is approximately 1/16 inch so that the string line 5 does not touch the work piece to which the line block 8 is being hooked. In each of the pieces of the line block 8 there is a groove 13 in a side corner thereof as shown in FIG. 2 as well as in FIG. 4 of the drawing. The purpose of the groove 13 will be explained later with respect to FIG. 4. These dimensions for the line block 8 of this invention are for a conventional chalk line box 2 having a width of approximately 1 inch and a substantially flat edge of approximately 3 inches. Of course, the overall dimensions of the line block 8 may vary depending on the size of the chalk line box used. Each piece of the line block 8 may be constructed from plastic although other materials such as metal, metal alloy or wood can also be used. Each piece of the line block 8 is affixed by an appropriate adhesive, e.g., an epoxy, to the flat edge of a two sectioned chalk line box 2. Other well known adhesives may also be used depending on the materials of the line block 8 and the chalk line box 2. A further modification of the line block 8 is to make the protrusions 10*a* and 10*b* collapsible onto sections 9*a* and 9*b* so that the string line box tool 1 is more compact.

Figure 3:
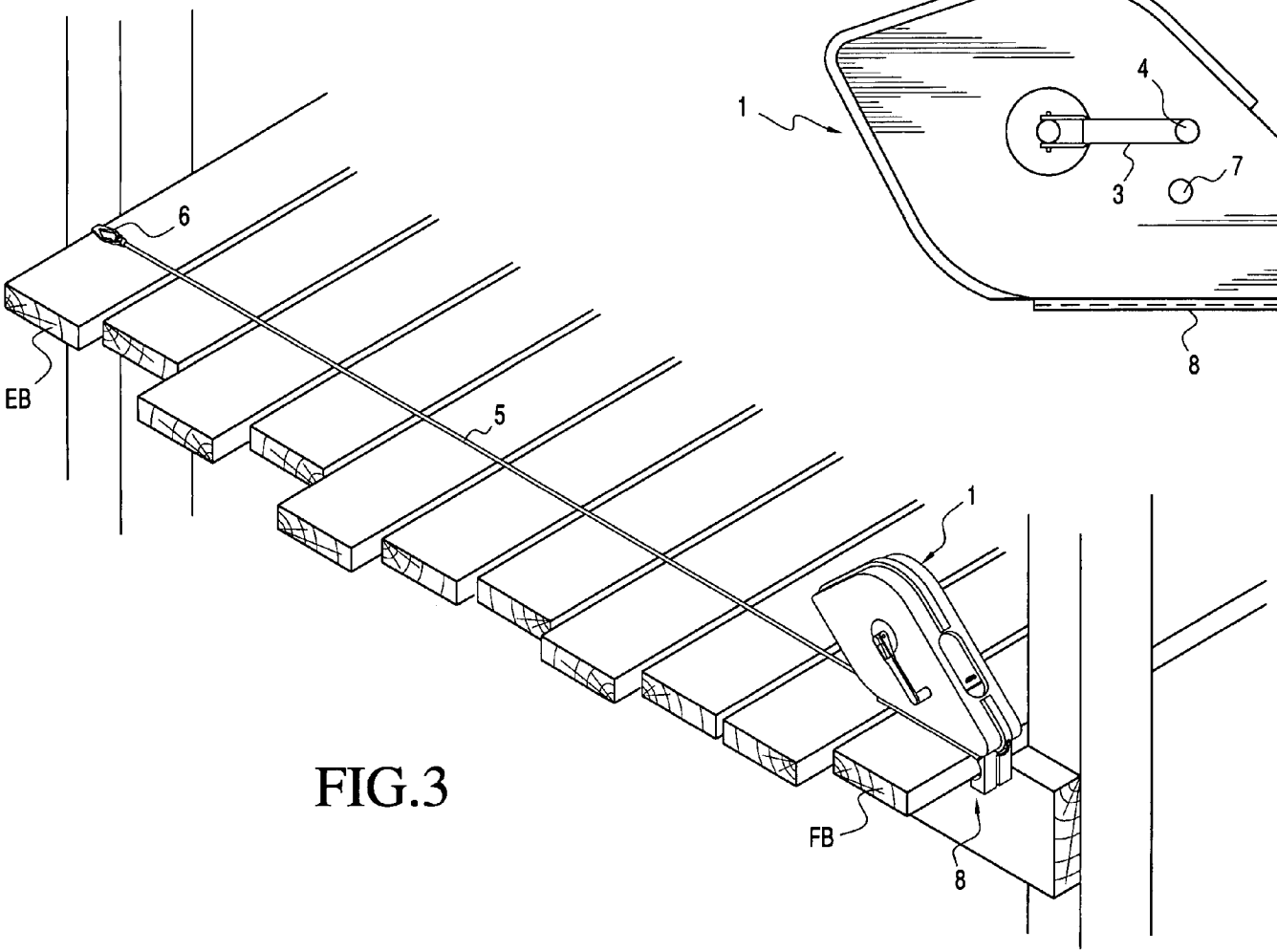
FIG. 3 shows an application of the string line box tool of this invention.

FIG. 3 shows an example of how the string line box tool 1 of this invention can be used. In order to provide a guide line for uniformly cutting the ends of a plurality of boards for a deck, the L-shaped metal hook 6 of the string line box tool 1 of this invention is attached to the edge of an end board EB and, with the crank 3 of the chalk line box 2 in the unlocked condition, a worker pulls the chalk line box 2 and the string line 5 under tension towards a front board FB and slides the hook protrusion of the elongated element 8 over the far edge of the front board FB and inserts the handle 4 of the crank 3 into the hole or well 7 in order to lock the chalk line box 2 and thus prevent any movement of the string line 5 in a forward or reverse direction. Thus, with the string line box tool 1 held in position, a worker can mark a chalk line along the boards of the deck for cutting. In some applications, the line block hook (protrusions 10*a* and 10*b*) can act as a pivot to elevate the string line 5 in order that it can be snapped by a worker wearing gloves.

Figure 4:
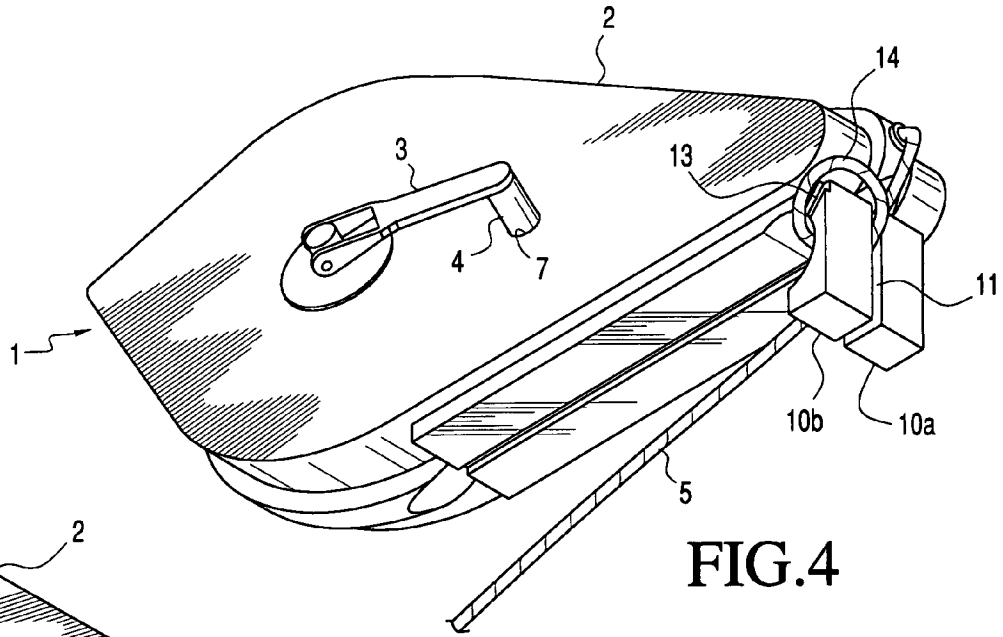
FIG. 4 is another perspective view of the string line box tool of this invention in a locked condition.

Referring now to FIG. 4, there is shown a condition of a locked chalk line box 2 when a worker overshoots the exact positioning of the string line box tool 1 of this invention. In such a situation, with the chalk line box 2 in a locked condition, the worker wraps the overplay 14 or extra string of the string line 5 around the protrusion 10*b* (as shown) or protrusion 10*a* and into the groove 13 in the side of the protrusion 10*b* (as shown) or protrusion 10*a*. By so doing, enough tension in the string line 5 will be obtained in order for it to be free holding. In order to better understand this situation reference is again made to FIG. 3. If the worker had pulled the chalk line box 2 slightly beyond the trailing edge of the front board FB such that the hooked protrusions 10*a* and 10*b* extend slightly beyond the trailing edge of the front board FB there would be an overplay or extra string extending beyond it. The worker puts the chalk line box 2 in a locked condition and wraps the overplay or extra string around one of the protrusions 10*a* or 10*b* one or more times until the string line 5 is in a taught condition sufficient enough to be able to hook the line block 8 over the trailing edge of the front board FB thereby maintaining the string line box tool 1 in a free holding condition.

Figure 6:
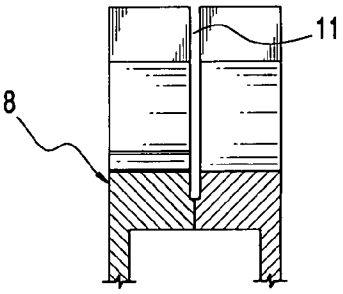
FIG. 6 is a partial cross-sectional view taken along lines 6, 6 in FIG. 5.
Figure 5:
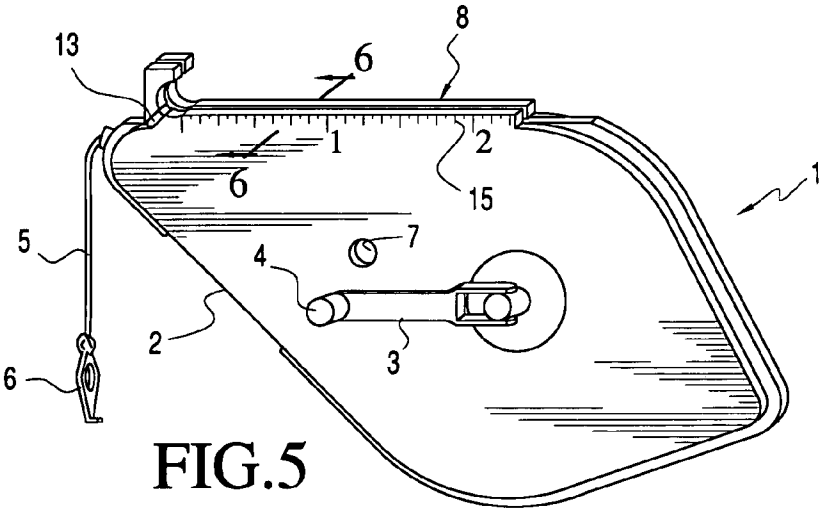
FIG. 5 is a side perspective view of another embodiment of this invention.

FIG. 5 shows another or preferred embodiment of the string line box tool 1 of my invention wherein the line block 8 is made integral with the two sides or halves of the chalk line box 2. This can be done by any molding or stamping procedure well known in the manufacturing art. An additional feature of this embodiment is the provision of a ruler 15 etched into both sides of the line block 8. Such a feature comes in handy where small measurements in a work project are necessary in conjunction with the use of a chalk line box 2; no need to use a separate ruler to perform such a measurement. This area of the line block 8 can also be used as a square for small straight lines on materials such as 2×4's and furring strips. FIG. 6 shows in more detail a cross section through the line block 8 and partially through the chalk line box 2. The spacing 11 between the two sections of the line block 8 is clearly shown as well as a partial showing of the two halves of the chalk line box 2.

Figure 7:
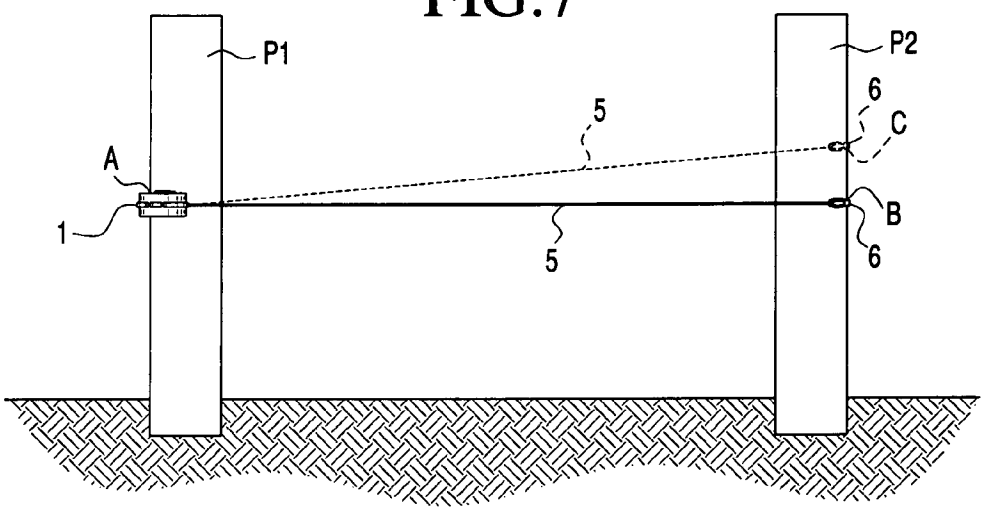
FIG. 7 shows another application of the string line box tool of this invention.

FIG. 7 shows the versatility of the string line box tool 1 of this invention. For example, once the string line box tool 1 is fixed in a free holding position between two posts P1 and P2 at a position between point A and point B the string line 5 can be moved at the metal hook 6 to point C on post P2 and still maintain its free holding condition.

Figure 8:
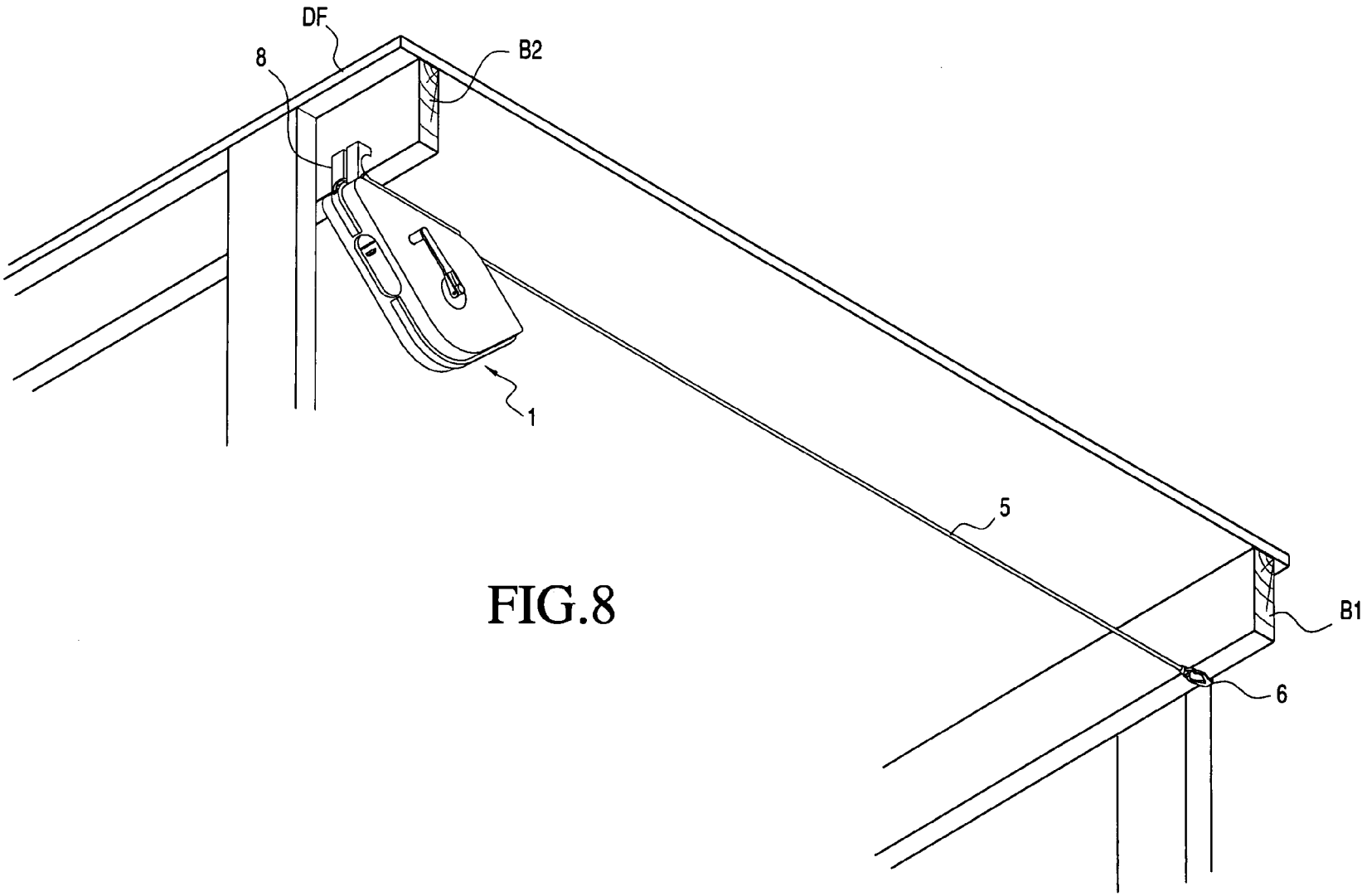
FIG. 8 shows a further application of the string line box tool of this invention.

FIG. 8 is another example of the sturdiness of the free holding capability of the string line box tool 1 of this invention. DF is the floor of an outdoor deck and B1 and B2 are support beams beneath the floor DF. The L-shaped metal hook 6 is hooked onto support beam B1 a by a worker who then pulls the chalk line box 2 towards the other support beam B2 and hooks the line block 8 onto the support beam B2 as shown in FIG. 8. The string line box tool 1 is suspended between the two support beams and does not fall to the ground because of its sturdiness.

Modifications of this invention will be readily apparent to those skilled in the art and it is intended that the invention be not limited by the embodiments disclosed herein but that the scope of the invention be defined by the appended claims.

What is claimed is:

1. A string line box tool comprising a pair of clam shaped sections joined together by screws or bolts, an opening between said pair of clam shaped sections, a chalk pouch contained within said clam shaped sections near said opening, a string line within said clam shaped sections which string line is extendable from a reel within said clam shaped sections through said opening and retractable to said reel by a lever arm and handle on one of said sections, a hole in a side of one of said clam shaped sections for locking said lever arm and handle so that said string line is unable to be further unreeled, a L-shaped metal tab or hook connected to a free end of said string line externally of said clam shaped sections, a line block divided into two separate pieces, each separate piece being attached to a substantially flat edge portion of said pair of clam shaped sections such that there is a space between said separate pieces for the string line to be guided and passed therethrough and each separate piece having an elongated portion and a hook shaped protrusion at one end of said separate piece near said opening.

2. The string line box tool of claim 1 wherein each of said separate pieces is attached to a respective flat edge potion of said clam shaped sections by an adhesive.

3. The string line box tool of claim 1 wherein each of said separate pieces is integral with a respective clam shaped section and spaced from each other by an approximate thickness of said string line.

4. The string line box tool of claim 3 wherein there is rule etched or marked along a flat outside face of each of said elongated portions.

5. The string line box tool of claim 1 wherein there is a groove in the non-facing side of each of said pieces at approximately the area joining said hook shaped protrusion and said elongated portion.

6. The string line box tool of claim 1 wherein there is rounded section between said hook shaped protrusion and said elongated portion of each of said pieces.

7. A string line box tool comprising a chalk line box and a line block integral therewith, said chalk line box having an opening therein for the passing of an internal string line therethrough, said line block comprising a pair of adjacently spaced sections, each section having an elongated portion and a hook shaped portion, said hook shaped portion being near said opening in said chalk line box for extending said string line rewardly from said chalk line box and an L-shaped tab or hook attached to a free end of said string line.

8. The string line box tool of claim 7 wherein said chalk line box has a pair of abutting shells with a peripheral edge, said line block being attached along a portion of said peripheral edge and said portion of said peripheral edge forming a boundary between said sections.

9. The string line box tool of claim 7 wherein each said section is spaced from each other by approximately the thickness of said string line.

10. The string line box tool of claim 9 wherein each of said elongated portions has a substantially flat outer face and there is rule etched or marked along said substantially flat outer face.

11. The string line box tool of claim 7 wherein there is a groove in the non-facing side of each of said sections at approximately the area joining said hook shaped portion and said elongated portion.

12. The string line box tool of claim 7 wherein there is rounded section between said hook shaped portion and said elongated portion of each of said sections.

13. A string line box tool comprising a pair of adjoining half shells and a line block, said adjoining half shells and said line block being integral with each other, said line block having two adjacently spaced sections, each said spaced section having an elongated portion and a hook shaped protrusion, wherein both said elongated portion and said hook shaped protrusion of each said spaced section contact one of said half shells to form a unitary member a string line within said pair of adjoining half shells, a chalk pouch within said pair of half shells, said string line passing through said chalk pouch, an opening between said pair of half shells, said opening being large enough for said string line to pass through, said string line being wound around a reel within said pair of half shells and having a free end external of said opening between said pair of adjoining half shells, said free end of said string line having an L-shaped tab or hook attached thereto, one of said pair of half shells having an arm and a handle attached to said reel, said pair of half shells having a peripheral edge a portion of which forms a boundary for said line block and its two adjacently spaced sections, said boundary and said adjacently spaced sections providing a groove for said string line to pass therethrough and means for locking further movement of said reel.

14. The string line box tool of claim 13 wherein there is a rounded portion between said elongated portion and said hook shaped protrusion of each of said adjacently spaced sections.

15. The string line box tool of claim 13 wherein there is a rule etched or marked along an external substantially flat side of said elongated portion of each of said two adjacently spaced sections.

16. The string line box tool of claim 13 wherein the spacing between said two adjacently spaced sections of said line block is approximately the thickness of said string line.

17. The string line box tool of claim 13 wherein said pair of adjoining half shells are fastened together by screws or bolts.

18. The string line box tool of claim 13 wherein said means for locking further movement of said reel is automatic.

19. The string line box tool of claim 13 wherein there is a groove in the non-facing side of each of said sections at approximately the area joining said hook shaped protrusion and said elongated portion.

20. The string line box tool of claim 7 wherein said chalk line box has means for locking further movement of said string line.

* * * * *